United States Patent [19]

Fujikawa et al.

[11] Patent Number: 4,682,573

[45] Date of Patent: Jul. 28, 1987

[54] VALVE GEAR FOR USE IN A FOUR CYCLE ENGINE

[75] Inventors: Tetsuzo Fujikawa, Kobe; Makizo Hirata; Shinichi Tamba, both of Kakogawa, all of Japan

[73] Assignee: Kawasaki Jukogyo Kabushiki Kaisha, Japan

[21] Appl. No.: 862,170

[22] Filed: May 9, 1986

Related U.S. Application Data

[63] Continuation of Ser. No. 578,631, Feb. 9, 1984, abandoned.

[30] Foreign Application Priority Data

Feb. 15, 1983 [JP] Japan ..... 58-24442

[51] Int. Cl.[4] ..... F01L 1/32

[52] U.S. Cl. ..... 123/90.2; 123/90.28

[58] Field of Search ..... 123/90.1, 90.2, 90.21, 123/90.48, 90.61, 90.28, 90.6

[56] References Cited

U.S. PATENT DOCUMENTS

| | | | |
|---|---|---|---|
| 577,536 | 2/1897 | Peugeot | 123/90.2 |
| 622,876 | 4/1899 | Anderson | 123/90.6 |
| 1,101,352 | 6/1914 | Sumbler | 123/90.2 |
| 1,177,428 | 3/1916 | Melin | 123/90.6 |
| 1,248,597 | 12/1917 | Baker | 123/90.2 |
| 1,409,710 | 3/1922 | Haltenberger | 123/90.2 |
| 1,741,090 | 12/1929 | Adam | 123/90.2 |
| 1,817,153 | 8/1931 | Kinder | 123/90.2 |
| 2,485,951 | 10/1949 | Zimmerman | 123/90.2 |
| 2,843,095 | 7/1958 | Prentice | 123/90.2 |
| 3,574,304 | 4/1971 | Santi | 123/90.28 |
| 4,007,716 | 2/1977 | Jones | 123/90.28 |
| 4,424,772 | 1/1984 | Porter | 123/90.6 |

FOREIGN PATENT DOCUMENTS

| | | | |
|---|---|---|---|
| 451470 | 8/1936 | United Kingdom | 123/90.28 |

*Primary Examiner*—Charles J. Myhre
*Assistant Examiner*—David A. Okonsky
*Attorney, Agent, or Firm*—Leydig, Voit & Mayer

[57] ABSTRACT

Disclosed is a valve gear for use in a four-cycle engine which eliminates the necessity of providing a cam shaft. In the valve gear, a guide or guides, each of which is shaped like a closed curve making two rounds of a crank shaft with one intersection on the way, are provided. An air-intake valve and/or exhaust valve are controlled in accordance with the movement of a slider member sliding along the guide or guides.

1 Claim, 12 Drawing Figures

VALVE GEAR FOR USE IN A FOUR CYCLE ENGINE

This application is a continuation of application Ser. No. 578,631, filed Feb. 9, 1984, now abandoned.

BACKGROUND OF THE INVENTION

The present invention relates to a four-cycle engine which has an air-intake valve and exhaust valve.

In a conventional four-cycle engine, a cam shaft is provided separately from a crank shaft. The speed of rotation of this cam shaft is reduced to ½ of that of the crank shaft by means of a reduction gear comprised of, for example, gears, sprockets or the like, thereby causing a lifting of the air-intake valve and exhaust valve through the use of a cam provided on the cam shaft. This lifting system of prior art, which uses such a cam shaft, has the following drawbacks. (1) It is necessary to equip the valve gear with the above-mentioned cam shaft, which results in an increase in the manufacturing cost involved. (2) A large amount of time is required for machining the gears and sprockets used for speed reduction. (3) Mechanical noises are great in intensity. (4) A chamber for reception of the crank need be large with the result that it is difficult to miniaturize the section associated with the valve gear. (5) Since the air-intake valve and exhaust valve are disposed closely to each other, there is a likelihood that gas exchange becomes incomplete. And, (6) Since the air-intake valve and exhaust valve are close to each other, the cylinder undergoes a high thermal distortion.

SUMMARY OF THE INVENTION

The object of the present invention is to provide a valve gear which can eliminate the above-mentioned conventional drawbacks and which is simple in structure and low in noises and in which the valve disposition advantageous for the action or function, as well as for the mechanical strength, of the valves is possible.

The above object can be achieved by a valve gear comprising a guide means provided on the outer surface of a crank shaft and shaped like a closed curve making two rounds of a crank shaft with one intersection on the way, whereby at least one of the air-intake valve and exhaust valve is controlled by the movement of a slider member sliding in the guide means.

Other and further objects, features and advantages of the invention will appear more fully from the following description.

DETAILED DESCRIPTION OF THE PREFERRED EMBODIMENTS

Figure 1:
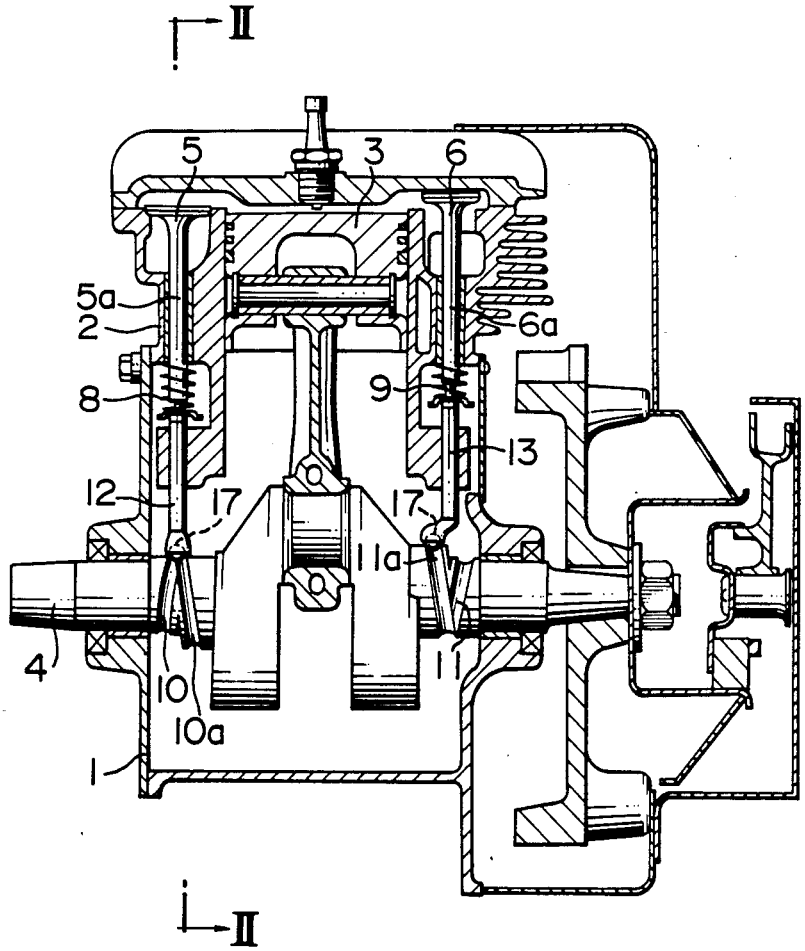
FIG. 1 is a side view, in vertical section, of a four-cycle engine to which the present invention is applied.

Referring now to FIG. 1, a cylinder block 2 is made integral with a crank case and is mounted with a crank case cover 1. A piston 3 is disposed within the cylinder block 2. Further, a crank shaft 4 is extended through the crank case. At the left and right side portions of the illustrated cylinder block 2, an air-intake valve 5 and an exhaust valve 6 are disposed, respectively, which air-intake valve 5 and exhaust valve 6 are equipped with valve stems 5*a* and 6*a*, respectively, and are supported by the cylinder block 2 in such a manner as to be made rockable about, and vertically slidable along, their axes, respectively, and are normally urged in the valve closing direction, i.e., in the downward direction, by means of valve springs 8 and 9, respectively.

Guide grooves 10 and 11 respectively used for the air-intake valve and exhaust valve are formed on those left and right side portions of the illustrated crank shaft 4 which are located within the crank case cover 1. Said guide grooves 10 and 11 are interlockingly connected to valves 5 and 6, respectively, through slider members 12 and 13.

The guide groove 10 used for the air-intake valve is shaped like a closed curve (See FIG. 4) making two rounds of the crank shaft 4 with one intersection on the way. The bottom surface of the guide groove 10 is formed into a cam surface and is provided with a raise 10*a* (See FIG. 1) protruded outwards in the radial direction of the crank shaft 4.

Figure 2:
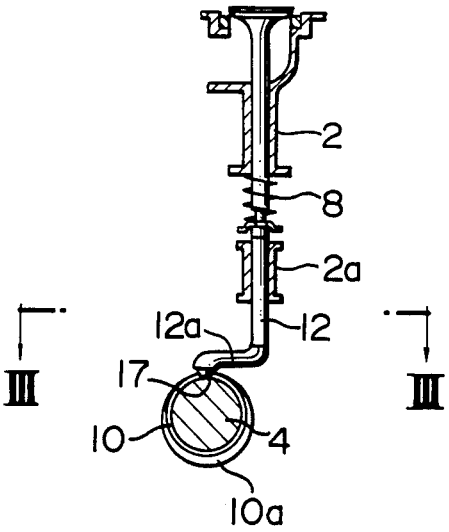
FIG. 2 is a sectional view taken along the line II—II of FIG. 1.
Figure 3:
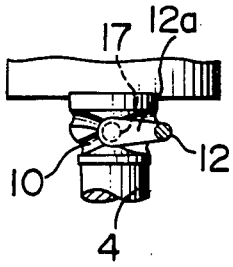
FIG. 3 is a sectional view taken along the line III—III of FIG. 2.

The slider member 12 for use in the air-intake valve is formed into a vertically elongated rod, and is rotatably and vertically movably supported by a supporting wall portion 2*a* of the cylinder block 2, as shown in FIG. 2. The slider member 12 is formed, at its lower end, with a horizontal arm portion 12*a* extending up to a position substantially right on an upper end edge portion of the crank shaft 4, which horizontal arm portion 12*a* is made rockable about a vertical axis of the slider member 12 integrally with this member 12. At a tip end portion of this arm portion 12*a*, a ball 17 is rotatably supported thereon, which ball 17 is engaged with the guide groove 10.

The slider member 13 for use in the exhaust valve and the guide groove 11 are respectively of similar structures to those of the slider member 12 for use in the air-intake valve and the guide groove 10. The raises 10*a*, 11*a* of the guide grooves 10 and 11 are formed at the angular positions of crank which correspond to the time periods in which the air-intake valve 5 and exhaust valve 6 are opened, respectively.

In operation, when the crank shaft 4 is allowed to rotate, for example the ball 17 for use in the air-intake valve is guided by the guide groove 10. During a time period in which the crank 4 makes its two rotations about its axis, said ball 17 is kept in sliding contact with the surface of the guide groove 10 throughout the entire length thereof. During this period, one lifting operation is imparted to the air-intake valve 5 by means of the raise 10*a*. Further, during the two-rotation period of the crank shaft 4, the arm portion 12*a* makes one reciprocating rocking movement, i.e., leftwards from the illustrated position of FIG. 1 and rightwards from the left position, thereby imparting a rocking operation to the air-intake valve 5.

As in the case of the air-intake valve, one lifting operation is imparted to the exhaust valve 6 by means of the raise 11*a* during the two-rotation period of the crank shaft 4 correspondingly to exhaust timing.

Figure 5:
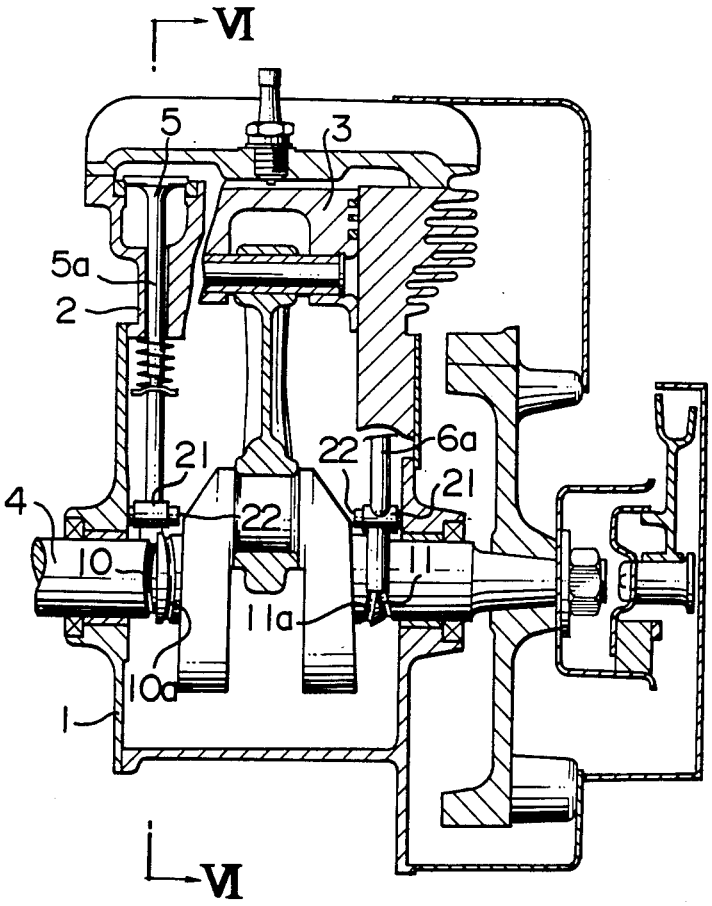
FIG. 5 is a side view, in vertical section, of the four-cycle engine according to another embodiment of the invention.
Figure 6:
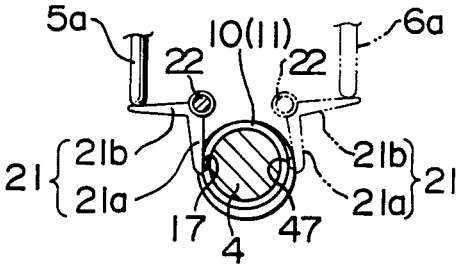
FIG. 6 is a sectional view taken along the line VI—VI of FIG. 5.

FIGS. 5 and 6 show the valve gear according to another embodiment of the invention. In this embodiment, the above-mentioned interlocking mechanism is constituted by bell cranks 21. Each bell crank 21 is fitted onto a support shaft 22 parallel with the crank shaft 4 so that it may be movable in the axial direction of, and rockable or rotatable about, the support shaft 22. A downwardly extending arm portion 21*a* (See FIG. 6) of the bell crank 21 has its lower end portion engaged with the guide groove 10 or 11 through the rotating ball 17. The respective tip end portions of horizontally extending arm portions 21*b* of the bell cranks 21 are allowed to abut, from below, against the lower end edges of the valve stems 5*a* and 6*a*, respectively.

Figure 4:
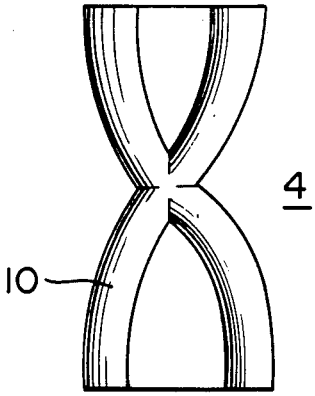
FIG. 4 is a development view of a guide portion.

As in FIG. 4, each guide groove 10 or 11 takes the form of a closed curve making two rounds of the crank shaft 4 with one intersection on the way and returning to its original position. The guide grooves 10 and 11 have their bottom surfaces shaped as cam surfaces, respectively, which bottom surfaces are formed with raises 10*a* and 11*a* at their angular positions of crank which correspond to the time of suction and exhaust, respectively.

It should be noted here that, in FIG. 5, those parts and sections which correspond to the parts and sections of FIG. 1 are denoted by like reference numerals, respectively.

In the valve gear of FIG. 5, during the period of two rotations of the crank shaft 4, each bell crank 21 is rocked about the support shaft 22 by the cam action of the raise 10*a* or 11*a* at the time of air suction or exhaust, thereby causing a lifting of the air-intake valve 5 or exhaust valve 6.

Figure 7:
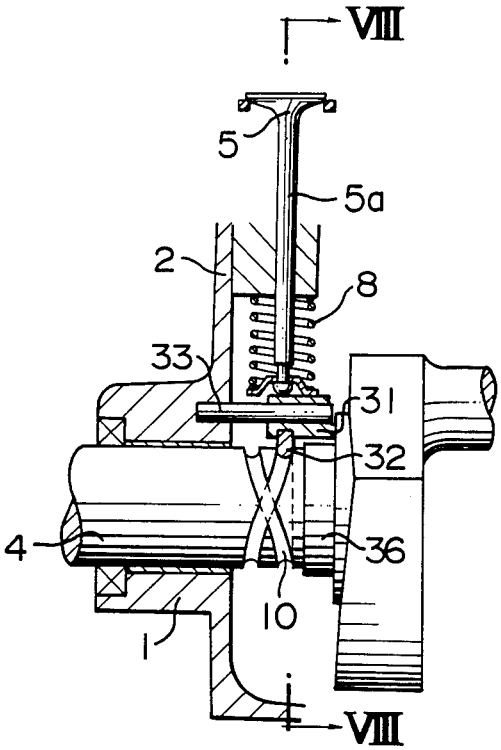
FIG. 7 is a side view, in vertical section, of the four-cycle engine according to still another embodiment of the invention.
Figure 8:
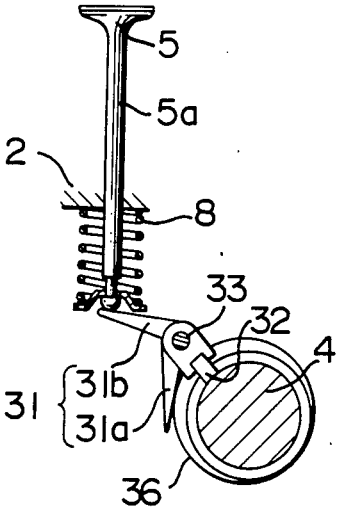
FIG. 8 is a sectional view taken along the line VIII—VIII of FIG. 7.

FIGS. 7 and 8 show the valve gear according to still another embodiment of the invention, in which the interlocking mechanism is constituted by a bell crank 31 and a slider member 32. The bell crank 31 is fitted to a support shaft 33 parallel with the crank shaft 4 so that it may be movable in the axial direction of, and rockable about, said support shaft 33. The slider member 32 is secured to the bell crank 31 and at the same time engaged with the guide groove 10.

The guide groove 10 is formed into a closed curve making two rounds of the crank shaft 4 and returning to its original position. The crank shaft 4 is formed with a cam surface 36 separately from the guide groove 10, at the position adjacent to the same.

A horizontally extending arm portion 31*b* (See FIG. 8) of the bell crank 31 is so formed that its width taken in the axial direction of the support shaft 33 may be enlarged. As a consequence, the arm portion 31*b* can abut against the lower end edge of the valve stem 5*a* at all times independently of the axial movement of bell crank 31. A downwardly extending arm portion 31*a* of the bell crank 31 is so formed that its axial width may be narrower or smaller than that of the horizontal arm portion 31*b*. The arm portion 31*a* abuts against the cam surface 36 during only a period in which the bell crank 31 is moved to the side of the cam surface 36 as shown in FIG. 7. That is to say, during the period of two rotations of the crank shaft 4, the downwardly extending arm portion 31*a* abuts against the cam surface 36 for only a period corresponding to substantially one rotation of the crank shaft 4.

Although not shown, the exhaust valve is arranged such that it undergoes a lifting operation by means of the bell crank 31 and slider member 32 similar to those of the air-intake valve.

In the valve gear of FIGS. 7 and 8, the valve 5 is once pushed up during the two-rotation period of the crank shaft 4 through the axial reciprocating movement of the slider member 32 and bell crank 31 made by the engagement between the slider member 32 and the guide groove 10 as well as through the rocking movement of the bell crank 31 about the support shaft 33 made by abutment between the downwardly extending arm portion 31*a* and the cam surface 36. That is to say, during the period of two rotations of the crank shaft 4, the arm portion 31*a* is kept in engagement with the cam surface 36 to once push up the valve 5 by the cam action caused thereby, for only a length of time corresponding to the period of substantially one rotation of the crank shaft 4 in which the slider member 32 abuts against a right half portion of the guide groove 10 illustrated in FIG. 7.

As in the case of the air-intake valve 5, the exhaust valve is also pushed up once for the period of two rotations of the crank shaft 4.

Figure 9:
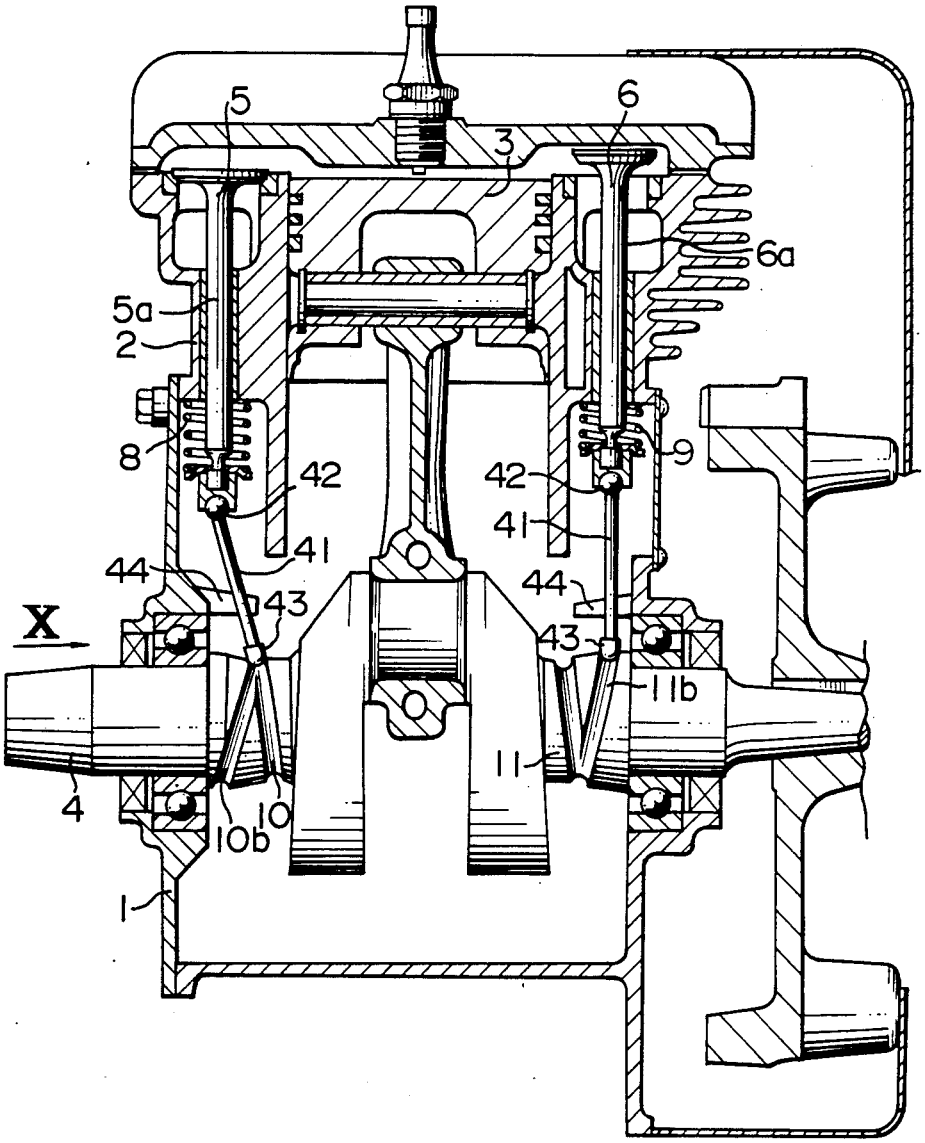
FIG. 9 is a side view, in vertical section, of the four-cycle engine according to a further embodiment of the invention.
Figure 10:
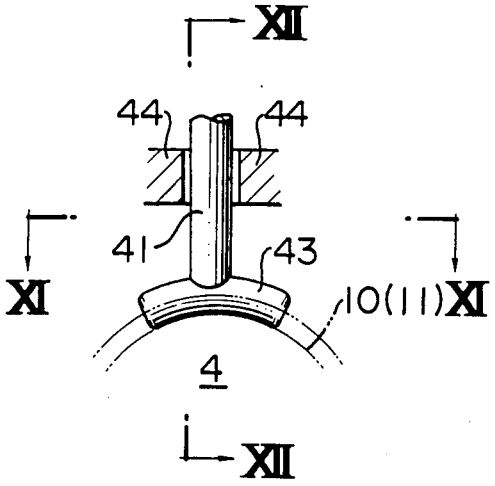
FIG. 10 is an enlarged partial view as viewed from an arrow X of FIG. 9.
Figure 11:
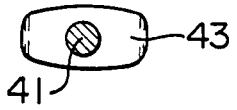
FIG. 11 is a sectional view taken along the line XI—XI of FIG. 10.
Figure 12:
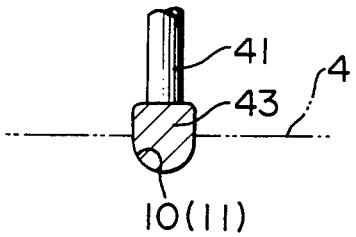
FIG. 12 is a sectional view taken along the line XII—XII of FIG. 10.

FIGS. 9 to 12 show the valve gear according to a further embodiment, or fourth embodiment, of the present invention, in which the interlocking mechanism is constituted by a push rod 41. Each push rod 41 has its upper end pivotally connected to the lower end of the valve 5 or 6 through a ball joint 42. The lower end portion of the push rod 41 is made rockable in the longitudinal direction of the crank shaft 4. As shown in FIG. 10, the push rod 41 is formed, at its lower end, with a sliding contact portion 43 shaped like a circular arc as viewed in the direction indicated by arrow mark X of FIG. 9, which sliding contact portion 43 is engaged with the corresponding guide groove 10 or 11. The lower side portion of the sliding contact portion 43 is shaped, in cross section, like a circular arc in match with the shape, in cross section, of the guide groove 10 (11) as shown in FIG. 12.

As in FIG. 4, each guide groove 10 or 11 is shaped like a closed curve making two rounds of the outer surface of the crank shaft 4 and returning to its original position with one intersection on the way. The guide groove 10 for use in the air-intake valve is slightly protruded, at its left side portion 10*b* of FIG. 9, in the outward direction of the crank shaft 4 taken radially thereof. On the other hand, the guide groove 11 for use in the exhaust valve is also slightly protruded, at its right side portion 11*b* of FIG. 9, in the outward direction of the crank shaft 4 taken radially of the same.

The push rod 41 has its intermediate portion inserted between a pair of guide members 44 as shown in FIG. 10, whereby the push rod 41 is prevented, by the guide members 44, from being rocked in a direction perpendicular to the axis of the crank shaft 4.

In the valve gear shown in FIGS. 9 to 12, a lifting operation is imparted to each valve 5 or 6 by the rocking movement of the push rod 41 in the axial direction of the crank shaft 4. That is to say, each push rod 41 makes one reciprocating rocking movement in the axial direction of the crank shaft 4 during the period of two rotations thereof. Thus, when the lower end sliding contact portion 43 of the push rod 41 is kept in sliding contact with the left side portion 10*b* of the guide groove 10, the push rod 41 at the side of the air-intake valve pushes up the air-intake valve 5. On the other hand, the exhaust valve 6 is pushed up when the lower end sliding contact portion 43 of the push rod 41 is kept in sliding contact with the right side portion 11*b* of the guide groove 11 as in FIG. 9.

In FIG. 9, the same parts and sections as those of FIG. 1 are denoted by like reference numerals.

It should be noted here that guide rails having convexed surfaces may be provided, in place of the guide grooves, as the guide portions or means.

As described above, according to the present invention, (1) since it is possible to eliminate the necessity of using a cam shaft, a large reduction in the manufacturing cost involved can be achieved and further the engine can be made more compact. (2) Since machining or fabricating the gears and sprockets used for reduction in speed of the cam shaft becomes unnecessary, a smaller amount of time is only required for manufacturing the valve gear. (3) It is possible to decrease the mechanical noises in magnitude. (4) It is possible readily to adopt what is called "cross-flow" type valve disposition structure wherein the air-intake valve and exhaust valve are disposed with a combustion chamber interposed therebetween, because both the valves need not be disposed close to each other. Accordingly, the efficiency with which the gas is filled increases, and, at the same time, the cylinder undergoes less thermal distortion. (5) Since the slider members 12 and 13 of FIG. 1 can impart suitable rotary rocking movements to the valves 5 and 6, respectively, it is possible to abolish the use of valve rotators which conventionally rotate the valve stem and valve incrementally in one direction each rotation of the crank shaft. The valve stems 5*a* and 6*a* are respectively rotated due to engagement by the slider members 12 and 13. The abutting force between the engaging surfaces is greater in the lifting phase than in the dropping phase which produces a greater amplitude of rotation in one direction during the lifting phase than in the opposite direction during the dropping phase. The rotation pattern produces positive rotation of the valves in the one direction, to remove deposits and prevent unsymmetrical wear which is the objective of conventional valve rotators. (6) Since, in the fourth embodiment of the invention, a bell crank is utilized for the interlocking mechanism, it becomes unnecessary to dispose the air suction valve and exhaust valve right above the crank shaft, with the result that the latitude of taking the positions of both valves is enlarged. Thus, the manufacturing and assembling operations become easy.

In the described embodiments, both the air-intake valve and exhaust valve are so arranged as to operate through the use of the guide portions and their interlocking mechanisms as shown in the Figures. According to the invention, however, arrangement can be made such that either the air-intake valve or the exhaust valve only operates through the use of the guide section and its interlocking mechanism. Further, where a bell crank is used, it is possible to arrange single guide section to guide two bell cranks for the air-intake valve and the exhaust valve.

Having described a specific embodient of our bearing, it is believed obvious that modification and variation of our invention is possible in light of the above teachings.

What is claimed is:

1. A valve gear for use in a four-cycle engine having a crank shaft, an air-intake valve having a stem, and an exhaust valve having a stem comprising:

(a) guide means formed by closed-curve grooves making two rounds of the outer surface of said crank shaft with one intersection on the way for controlling the movement of said air-intake valve and said exhaust valve of said engine upon rotation (b) slider means connected to operate each said valve stem under guidance of said guide means, said slider means including:

a vertically elongated rod portion supported for rotary rocking and reciprocating lifting and dropping movement relative to and along the axis of a corresponding valve stem and having an upper end surface engaging a lower end surface of the corresponding valve stem;

rocking means for reciprocating said rod portion and positively rotating carried thereby said rod portion in two directions opposite to each other upon rotation of the crank shaft, the engagement between the upper end surface of each rod portion and the lower end surface of each valve stem producing rotation of the valve stem in one direction during a lifting phase and in the opposite direction during a dropping phase, the amplitude of rotation produced during the lifting phase being greater than the amplitude of rotation produced during the dropping phase, whereby the valve stem and valve carried thereby are rotated incrementally in the one direction upon rotation of the crank shaft;

said rocking means comprising:

a horizontal arm portion extending from one end of said elongated rod portion and rockable about a vertical axis of said slider means; and a ball rotatably supported on the tip of said arm portion and guided by said guide means providing a low friction connection with said guide means as said crank shaft rotates to produce rocking movement of said horizontal arm portion and reciprocating and rotary rocking movement of said vertically elongated rod portion to operate each of said valves.

* * * * *